US007930908B2

(12) United States Patent
Ciabattini

(10) Patent No.: US 7,930,908 B2
(45) Date of Patent: Apr. 26, 2011

(54) MACHINE AND METHOD FOR TREATING BOTH AN OPEN WIDTH FABRIC AND A FABRIC IN ROPE FORM

(75) Inventor: Alberto Ciabattini, Prato (IT)

(73) Assignee: Coramtex S.R.L., Prato (IT)

( * ) Notice: Subject to any disclaimer, the term of this patent is extended or adjusted under 35 U.S.C. 154(b) by 1106 days.

(21) Appl. No.: 11/573,730

(22) PCT Filed: Aug. 8, 2005

(86) PCT No.: PCT/IT2005/000482
§ 371 (c)(1),
(2), (4) Date: Feb. 15, 2007

(87) PCT Pub. No.: WO2006/021978
PCT Pub. Date: Mar. 2, 2006

(65) Prior Publication Data

US 2007/0266741 A1 Nov. 22, 2007

(30) Foreign Application Priority Data

Aug. 25, 2004 (IT) ..... FI2004A0183

(51) Int. Cl.
*D06B 3/28* (2006.01)

(52) U.S. Cl. ..... 68/5 D; 68/9; 68/11

(58) Field of Classification Search ..... 68/5 D, 68/9, 11, 12.11
See application file for complete search history.

(56) References Cited

U.S. PATENT DOCUMENTS

| | | | | | |
|---|---|---|---|---|---|
| 2,759,324 | A | * | 8/1956 | Dean | 57/1 UN |
| 2,858,184 | A | * | 10/1958 | Bell et al. | 8/149.3 |
| 2,893,103 | A | * | 7/1959 | Ellison et al. | 26/1 |
| 3,330,134 | A | * | 7/1967 | Carpenter | 68/9 |
| 3,554,685 | A | * | 1/1971 | Stalter et al. | 8/111 |
| 4,592,107 | A | * | 6/1986 | von der Eltz | 8/149.1 |
| 5,014,525 | A | * | 5/1991 | Bene | 68/20 |
| 5,431,031 | A | * | 7/1995 | Vinas | 68/5 D |
| 6,425,271 | B1 | | 7/2002 | Vinas | |

FOREIGN PATENT DOCUMENTS

| | | |
|---|---|---|
| EP | 0 291 437 A2 | 11/1988 |
| EP | 0 341 183 | 11/1989 |
| GB | 307 632 | 3/1929 |
| GB | 375 156 | 6/1932 |
| GB | 889 395 | 2/1962 |
| GB | 1 195 093 | 6/1970 |
| GB | 2 158 472 | 11/1985 |
| WO | WO 03/023111 A1 | 3/2003 |

* cited by examiner

*Primary Examiner* — Joseph L Perrin
*Assistant Examiner* — Benjamin Osterhout
(74) *Attorney, Agent, or Firm* — McGlew & Tuttle, P.C.

(57) ABSTRACT

The machine provides a path (3) for feed of the fabric with a transfer system, for example a pneumatic system. Along the aforesaid path the fabric can be treated in rope form or in open width according to the machine settings.

40 Claims, 7 Drawing Sheets

MACHINE AND METHOD FOR TREATING BOTH AN OPEN WIDTH FABRIC AND A FABRIC IN ROPE FORM

TECHNICAL FIELD

The present invention relates to a machine for treating a fabric. More specifically, the invention relates to a machine capable of treating, with a continuous or discontinuous cycle, an open width fabric or a fabric in rope form.

The invention also relates to a respective method for the aforesaid treatment.

PRIOR ART

Machines are known in the field of textile processing and finishing, which subject piece goods to treatments both in a bath and without a bath with transfer of the fabric along a transfer path where said fabric is subjected to the action of one or more mechanical members, and optionally chemical action by enzymes and/or thermal action.

This type of machine normally operates with a discontinuous cycle. This means that piece goods of finished length is fed into the machine and closed by joining the head and tail of the piece together to form a sort of ring. This ring of fabric is made to circulate for an appropriate number of times, i.e. for a sufficient treatment time, along the treatment path. At the end of treatment, the machine is stopped, depressurized if necessary, opened and the treated fabric is removed therefrom to be replaced with a new fabric to be treated.

This type of machine has the drawback that it must be frequently stopped for loading and unloading. This results in loss of production and high labor costs. The need to depressurize and cool the machine (when it operates pressurized and/or at a temperature) also results in a considerable consumption of energy.

Therefore, machines have been studied which perform this type of processing with a continuous cycle. In these machines the fabric is fed into a first tank, passes through the machine following a transfer path and is removed gradually from a second tank at the opposite end of the path. A stock of fabric forms inside the machine, which moves with a greater speed than the speed at which it is fed into and removed from the machine, so that each section of fabric is subjected to more than one treatment.

At the current time, machines for the continuous treatment of open width fabric or machines for continuous treatment of fabric in rope form are produced.

Machines that process open width fabric have the advantage of not damaging the fabric with folds or defects caused by constriction of the rope, but also have the disadvantage of being unable to obtain a strong effect of physical treatment and softening due to the blander action that fabric impacted in width receives with respect to fabric in rope form.

The contrary occurs in machines that process fabrics in rope form.

GB-A-2158472 describes a machine for continuous treatment of an open width fabric. In this machine the fabric is gradually fed into a first chamber and gradually removed from a second chamber. The two chambers are joined to each other by a pneumatic path in the form of an overturned U, along which the open width fabric is transferred first in one direction and then in the other through the action of air jets.

U.S. Pat. No. 6,425,271 describes a machine similar to the previous one, the overturned U-shaped pneumatic system of which is provided with movable gates to increase the effect of physical treatment and softening during fall of the fabric.

EP 0,291,437 describes a machine for continuous treatment of open width fabric in which two chambers are joined to each other by a different pneumatic system, substantially S-shaped, along which the open width fabric is transferred first in one direction and then in the other through the action of air jets the flow of which is regulated alternatively by gates.

The mechanical operations which can be performed on the fabric with this type of machine are somewhat bland. Moreover, transfer of the fabric can be difficult due to the tortuousness of the paths and the limited efficacy of the air jets which act on the fabric during treatment.

EP-A-0341183 describes another machine, once again for continuous treatment of an open width fabric. In this case inside the machine the fabric is transferred alternatively from one chamber to the other by a substantially horizontal pneumatic path through the action of air jets. The fabric is impacted against mechanical treatment members, substantially produced with a finned rotating shaft, disposed in front of the outlets of the pneumatic path in the two chambers. Gate control means alternatively regulate the flow of the air jets. Also in this case the effectiveness of the treatment is limited.

WO-A-03023111 describes a machine for continuous treatment of fabric in rope form. In this machine the fabric is transferred alternatively from one chamber to the other with a reversible pivoting pneumatic system. The pneumatically transferred fabric is impacted against one or other of two grilles positioned in front of the outlets of a pivoting pneumatic transfer duct.

OBJECTS AND SUMMARY OF THE INVENTION

The object of the invention is to produce a machine for treating fabrics and the like, which is more versatile than known machines.

The object of the invention relates to a machine capable of treating an open width fabric or a fabric in rope form, with a rapid and preferably automatic conversion operation, i.e. without acting manually on the mechanics of the machine to switch from treating open width fabrics to treating fabrics in rope form or vice versa. Moreover, this machine can operate with a continuous cycle or with a discontinuous cycle.

According to one aspect, the invention relates to a machine which has means to treat said fabric alternatively open width and in rope form.

In particular, according to a possible preferred embodiment of the invention, a machine for treating a fabric is provided, comprising: a transfer path for the fabric; a transfer system and, optional fabric treatment systems; wherein said path has at least in part a variable geometry and/or movable elements, to allow the fabric to be transferred and processed in rope form or alternatively open width, preferably without acting manually on the mechanics of the machine to change the type of fabric being processed.

This transfer path is therefore advantageously formed at least in part of movable elements, in particular gates or rotatable fins, to produce a path suitable to transfer an open width fabric or a fabric in rope form. Advantageously, it is also possible to modify at least in part the geometry of said path using movable walls to adapt it to the form of the open width fabric or fabric in rope form, to allow optimal transfer of the fabric in both configurations.

During processing of the open width fabric the path will have at least one portion with an elongated approximately rectangular section, across which the fabric extends, while during processing of fabric in rope form the path will have at least one portion with an approximately square cross section, to conform to the section of the fabric in rope form.

The transfer system, advantageously included along said path, is preferably a pneumatic transfer system and the path is at least partly pressurized.

Advantageously, the pneumatic transfer system also operates to adapt to an open width fabric or to a fabric in rope form by activating transfer devices, such as blowers in the case of a pneumatic system, along the entire transverse direction of the open width fabric, or activating only the part of the transfer device or devices required to guarantee transfer of the fabric in rope form.

In an advantageous embodiment of the invention the transfer system transfers the fabric alternatively in two opposite directions, to also allow treatment with a continuous cycle.

In front of the transfer system, in particular at the end of the path in the direction of transfer of the fabric, at least one grille structure is advantageously provided, or preferably respectively two opposite grille structures in the case of treatment with continuous cycle, such as the ones described in WO-A-03023111, against which the fabric is impacted thanks to the kinetic energy imparted thereto by the transfer system, to increase the effect of physical treatment and softening of the fabric.

Grille structure is intended as any structure suitable to form an impact surface for the fabric and which at the same time lets air pass through. It can be formed of a series of horizontal and/or vertical bars, by a perforated sheet, by a continuous sheet with a central slot or a series of slots arranged in various ways, or the like.

On the opposite side of each grille structure with respect to the transfer system, a respective suction mouth of a pneumatic circuit can advantageously be provided, to alternatively suck the air delivered from the transfer system to increase the treatment efficiency of the machine. In fact, the flow of air sucked from the further pneumatic circuit allows acceleration of the fabric to be increased, in particular with each inversion of the direction of feed, and therefore allows the speed required to obtain efficacious treatment to be reached even when the fabric in the machine is relatively limited.

As both treatments in rope form and in open width can make use of high thrust powers and violent impacting against the impact surfaces after having passed through the pneumatic transfer tube (for example, in particular a Venturi tube), they offer appreciable results in terms of efficacy thereof and consequently breakage and softening of the fabric.

In particular, increased treatment efficiency also allows a reduction in the number of treatment transfers each section of fabric must be subjected to inside the machine, with a consequent increase in the productivity of the machine.

The machine according to the invention can be produced in a complete line and automatically which is fed with open width fabric and from which open width fabric is also delivered, notwithstanding the fact that the treatment takes place on fabric in rope form. Therefore, an unwinder of a large roll of fabric, a padding mangle, optional pre-drying cylinders to increase drying productivity can advantageously be provided in line, followed by synchronization means for feed to the machine (cylinder for open width fabric, bowl with ring for feed of fabric in rope form). The outlet is advantageously provided with a continuous rope opener if processing in rope form or with a folder or cuttler if processing open width fabric, and with a winder.

According to one embodiment, the machine according to the invention is of the type with a continuous cycle, comprising at least two tanks disposed in series and connected by said treatment path. Inside these tanks a stock of fabric is advantageously formed, which moves at a greater speed than the speed at which it is fed into and removed from the machine. As mentioned, the machine could also be configured to operate with a discontinuous cycle.

A bath can be provided inside the tanks, for example with suitable enzymes or other chemical products, destined to accomplish on the fabric an effect combined with the mechanical action to which the fabric is subjected during transfer inside the transfer member.

It must be understood that there can also be more than two treatment tanks present in the machine according to the invention and they can be disposed in series, aligned or also side by side with one another with a suitable system to divert the path of the fabric.

Therefore, the machine according to the invention can treat a dry or wet fabric. Moreover, it can be used for drying, steaming, for treatments in specific baths and the like.

According to another different aspect, the present invention relates to a method for treating a fabric along a path comprising a transfer system and optional mechanical treatment systems to select between rope form and open width processing mode and set at least in part the geometry of said path and/or the transfer system and allow transfer and processing of fabric in rope form or alternatively open width fabric according to said selection.

The main advantage of a machine according to the present invention is that it is extremely versatile, as with the same machine it allows treatments of open width or rope form fabric. If the configuration of the machine is modified automatically, it is also possible to switch from one type of treatment to the other without the need to stop the machine at each change of treatment. Alternatively, some or all the configuration operations of the machine to switch from one operating mode to the other could be performed manually. Also in this case, the advantage is still attained of being able to alternatively carry out treatment in rope form or treatment in open width with the same machine, and without manpower being required to make the adjustments.

Consequently both the costs and the production times decrease considerably. A reduction in energy consumption and an increase in the productivity of the machine can also be attained, especially if it is converted from one operating mode to the other without being allowed to cool down and/or without emptying any baths present therein.

Further advantageous characteristics and embodiments of the method and of the device according to the invention are indicated in the accompanying dependent claims and will be further described hereunder with reference to some non-limiting embodiments provided by way of example.

BRIEF DESCRIPTION OF THE DRAWINGS

The present invention can be better understood and its numerous objects and advantages shall be more apparent to those skilled in the art with reference to the accompanying schematic drawings, which show a non-limiting practical embodiment of the invention. In the drawing.

DETAILED DESCRIPTION OF THE PREFERRED EMBODIMENT OF THE INVENTION

Figure 1:
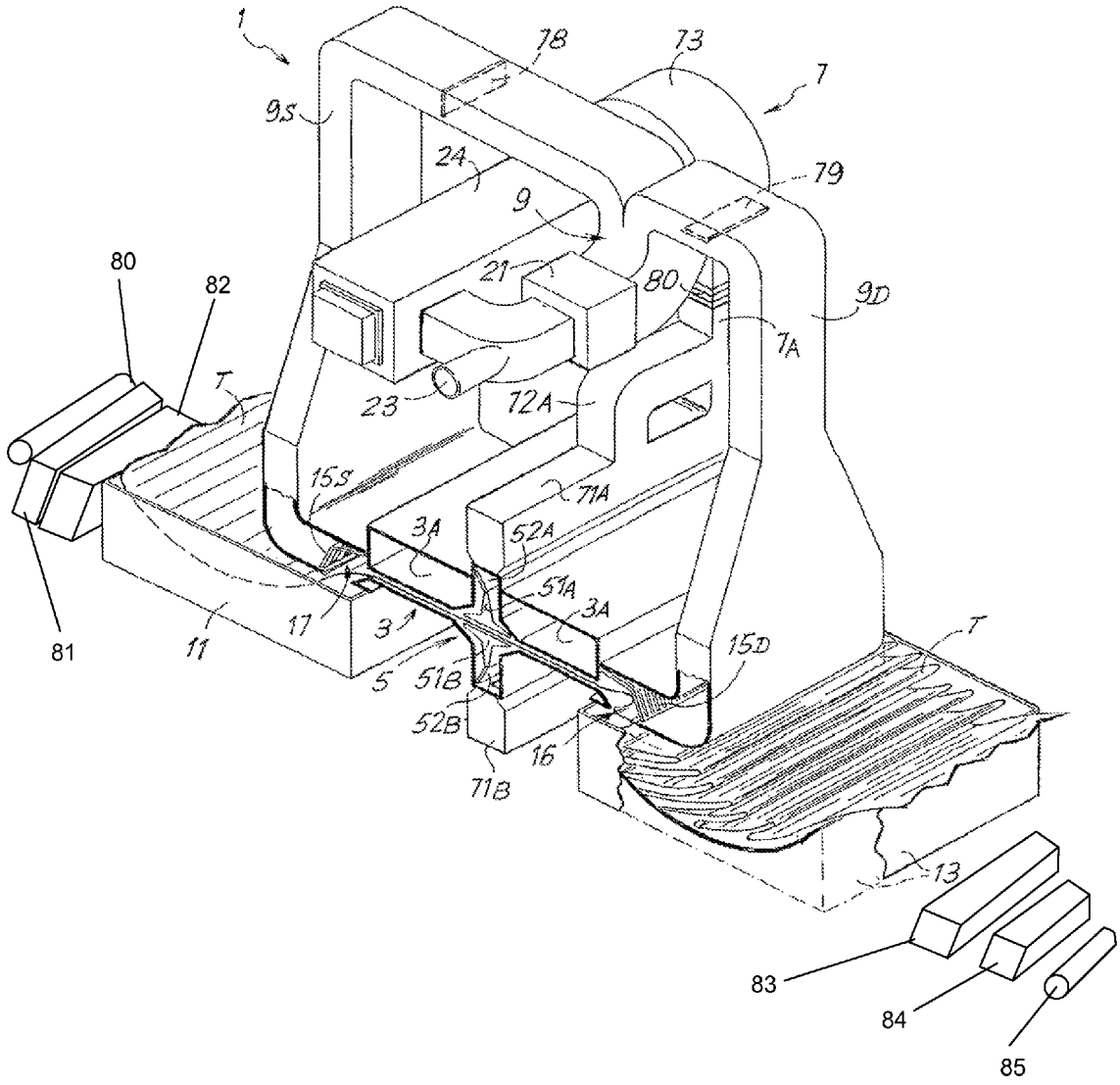
FIG. 1 shows an axonometric view of a machine according to the invention, configured to process an open width fabric.

In the drawings, in which equal or equivalent parts have the same numbers in all the different figures, a machine according to the preferred embodiment of the invention is indicated generically with 1. Hereinafter the machine will be described with initial reference to FIGS. 1 to 4, in which it is configured to treat an open width fabric T, i.e. extending according to the transverse direction thereof.

The machine 1 includes essentially a path 3, at least in part pressurized, inside which an open width fabric T travels, a bidirectional pneumatic transfer system 5 fed by a pneumatic circuit 7, and a further pneumatic circuit 9 for suction and recirculation of the air.

In the preferred embodiment, the machine according to the invention advantageously includes at the ends of the paths 3 respectively a first treatment tank 11 and a second treatment tank 13, in which a stock of fabric being processed forms alternatively.

In the layout shown in FIG. 1 the stock formed by the open width fabric T is accumulating in the tank 13 and the transfer member 5 is configured to pick up the fabric T from the tank 11 to transfer it to the tank 13, to form said stock, in the manner that will be described hereunder. One or more of an unwinder 80 of roll of fabric, a padding mangle 81 and pre-drying cylinders 82 may be provided in line on the inlet side of the system. One or more of a winder 85, a continuous rope opener 84 and a folder 83 may be provided in line on the outlet side of the system.

Figure 2:
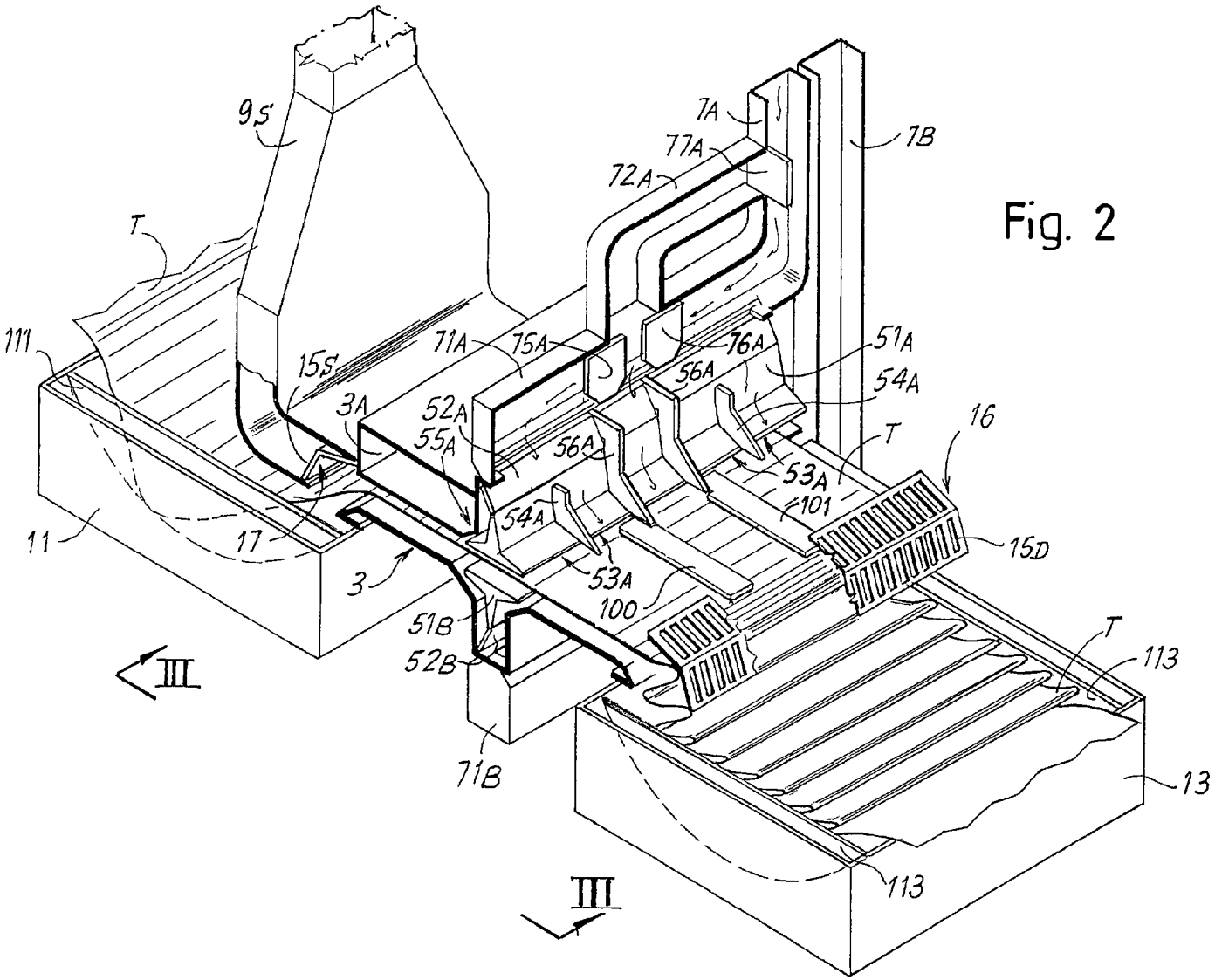
FIG. 2 shows the axonometric view in FIG. 1 partially in section.

In the preferred embodiment of the invention, the pneumatic transfer system 5 acts on transfer of the fabric T, see also FIG. 2, directing pressurized air by means of a diverter 51A positioned downstream of an air storage tank 71A by means of blowers 53A, directed to transfer the fabric towards the tank 13, and alternatively blowers 55A directed opposite the blowers 53A to transfer the fabric towards the tank 11.

FIG. 2 shows in particular the blowers 53A partially in section and delimited by vertical wall elements 54A to direct the flow of air more appropriately according to the direction of transfer of the fabric.

Said blowers 53A and 55A advantageously act along the entire width of the open width fabric T.

A gate 52A, advantageously hinged to the upper end of the diverter 51A, regulates the direction of flow of air alternatively towards the blowers 53A or towards the blowers 55A to transfer the fabric respectively towards the tank 13 or towards the tank 11. In FIGS. 1 and 2, the gate 52A is positioned to activate the blowers 53A and transfer the fabric T towards the tank 13.

The pneumatic transfer system 5 is fed by the pneumatic circuit 7 comprising a compressor or a fan 73, which delivers pressurized air through the duct 7A into the storage tank 71A.

This configuration advantageously has open gates 75A and 76A positioned inside the storage tank 71A, i.e. gates which allow air to flow along the entire storage tank 71A. A further gate 77A closes the inlet of a further central duct 72A downstream of the compressor 73 and upstream of the storage tank 71A, which is used when the machine is configured to treat fabric in rope form, as shall be described in greater detail hereunder.

The pressurized air delivered from the blowers 53A pushes the fabric against a grille 15 and is then sucked through a mouth 16, omitted for greater clarity in FIG. 2 but visible in FIG. 1, connected to the further suction and recirculation circuit 9, to provide a further thrust for the fabric T. A right duct 9D of the further suction circuit 9 connects the mouth 16 to the compressor 73, as shall be described in greater detail hereunder with reference to FIG. 3.

Advantageously, the suction circuit 9 is provided with a filter 21, a heat exchanger 24 for the air and an outlet 23 to eject part of the exhausted air.

Figure 3:
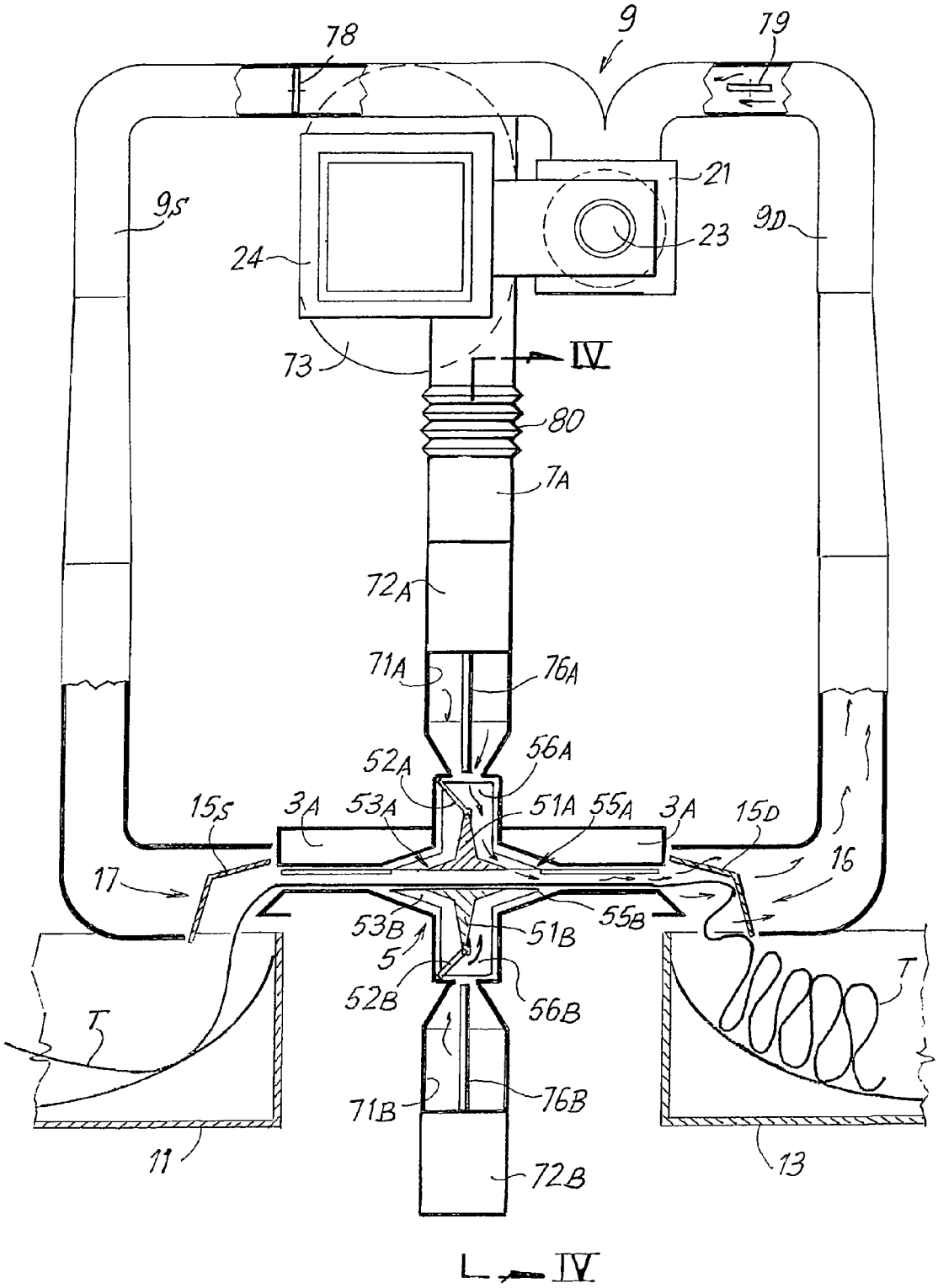
FIG. 3 shows a side view partially in section according to III-III in FIG. 2.

FIG. 3 shows in greater detail the air suction and recirculation circuit 9. This circuit is formed by two channels 9D and 9S which connect the mouths respectively 16 and 17 to the compressor 73 by means of gates 78 and 79 openable alternatively. In the configuration in FIG. 3 the gate 79 is open and allows air to circulate in the duct 9D through the grille 15D, while the gate 78 is closed to deactivate the duct 9S. The position of the gates 78, 79 is switched (opening the gate 78 and closing the gate 79) when the fabric must invert its movement and be transferred from the tank 13 to the tank 11 impacting against the grille 17.

FIG. 3 also shows a side view partially in section of the central area of the machine, which corresponds to the bidirectional pneumatic transfer system 5 composed of the elements described hereinbefore, indicated with the letter A and positioned above the open width fabric T. FIG. 3 shows how this pneumatic transfer system 5 is advantageously formed of further elements, specular to the first ones with respect to the fabric T, to transfer the fabric T with pressurized air from both sides.

More specifically, pressurized air is fed inferiorly to the fabric from a storage tank 71B through a duct 7B of the pneumatic circuit 7, see also FIG. 4, and a gate 52B directs the air towards opposite blowers 53B or 55B positioned below the fabric T to select the direction of transfer.

Respective gates 75B and 76B are positioned inside the storage tank 71B and in this configuration they are open to allow passage of pressurized air along the entire storage tank 71B. A respective gate 77B closes the passage of air from the duct 7B to a central channel 72B, so that the flow of air from the channel 7B is diverted into the storage tank 71B.

Figure 5:
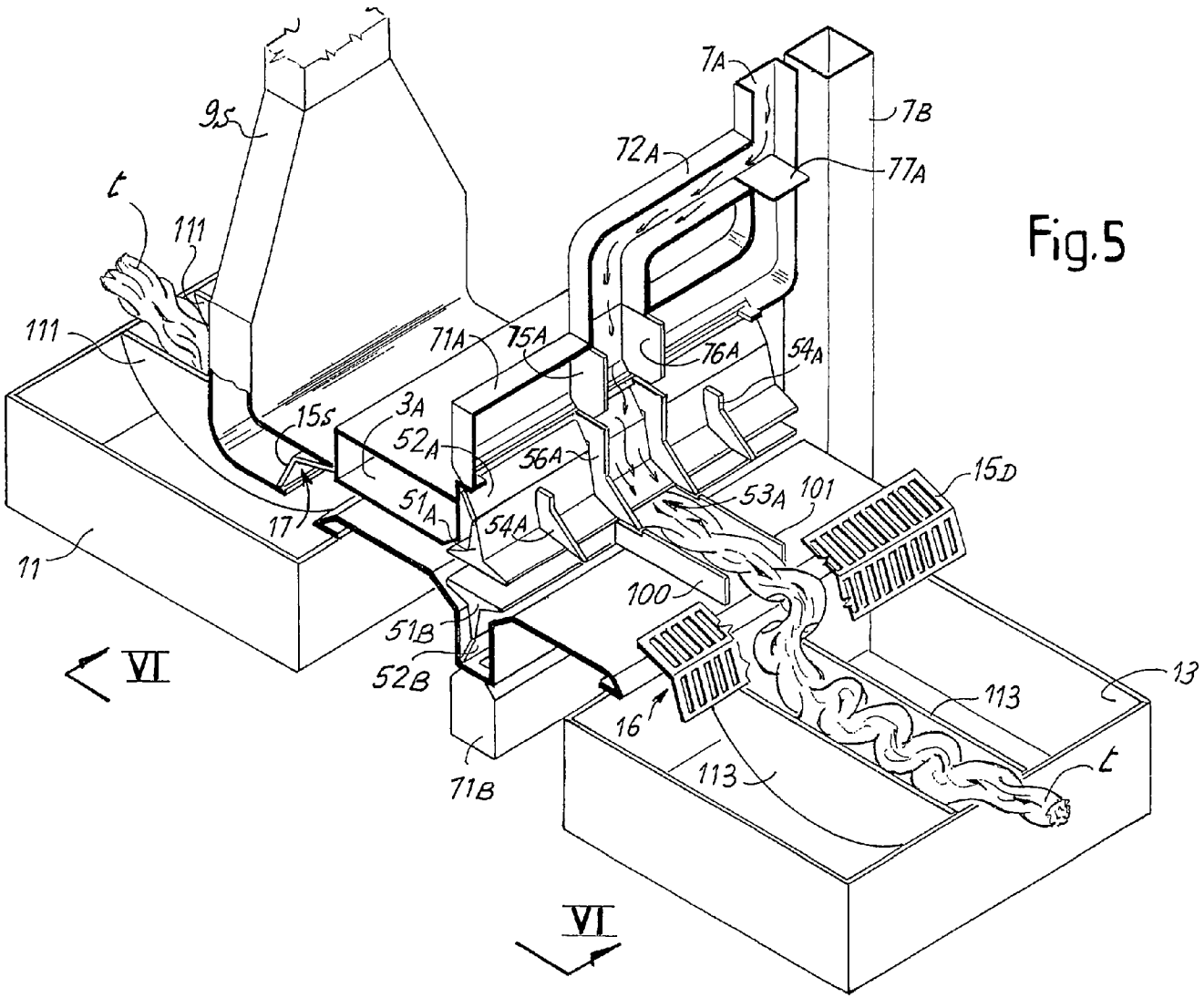
FIG. 5 shows the view in FIG. 2 of the machine configured to process fabric in rope form.
Figure 6:
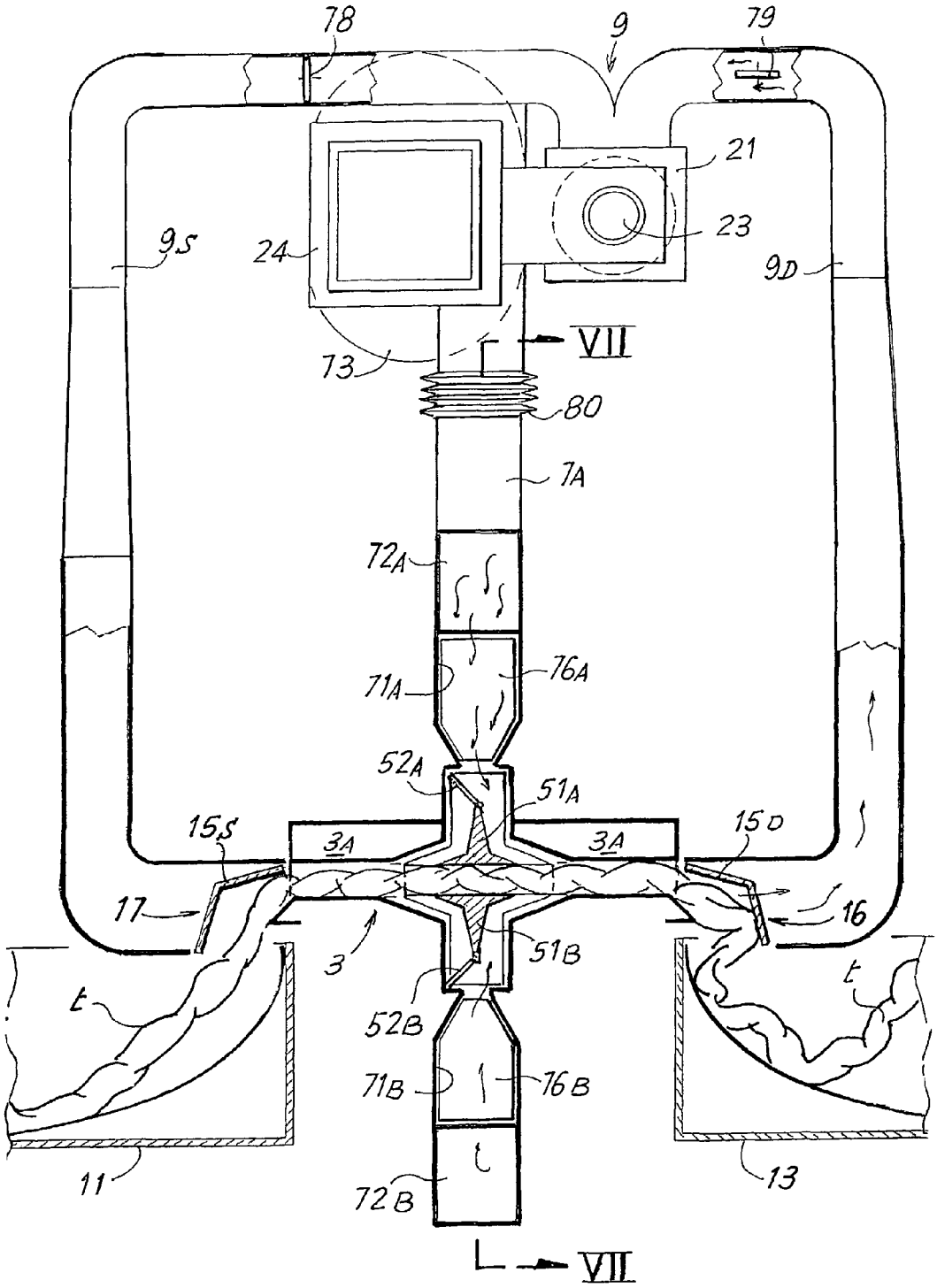
FIG. 6 shows a side view according to VI-VI in FIG. 5 partially in section.
Figure 7:
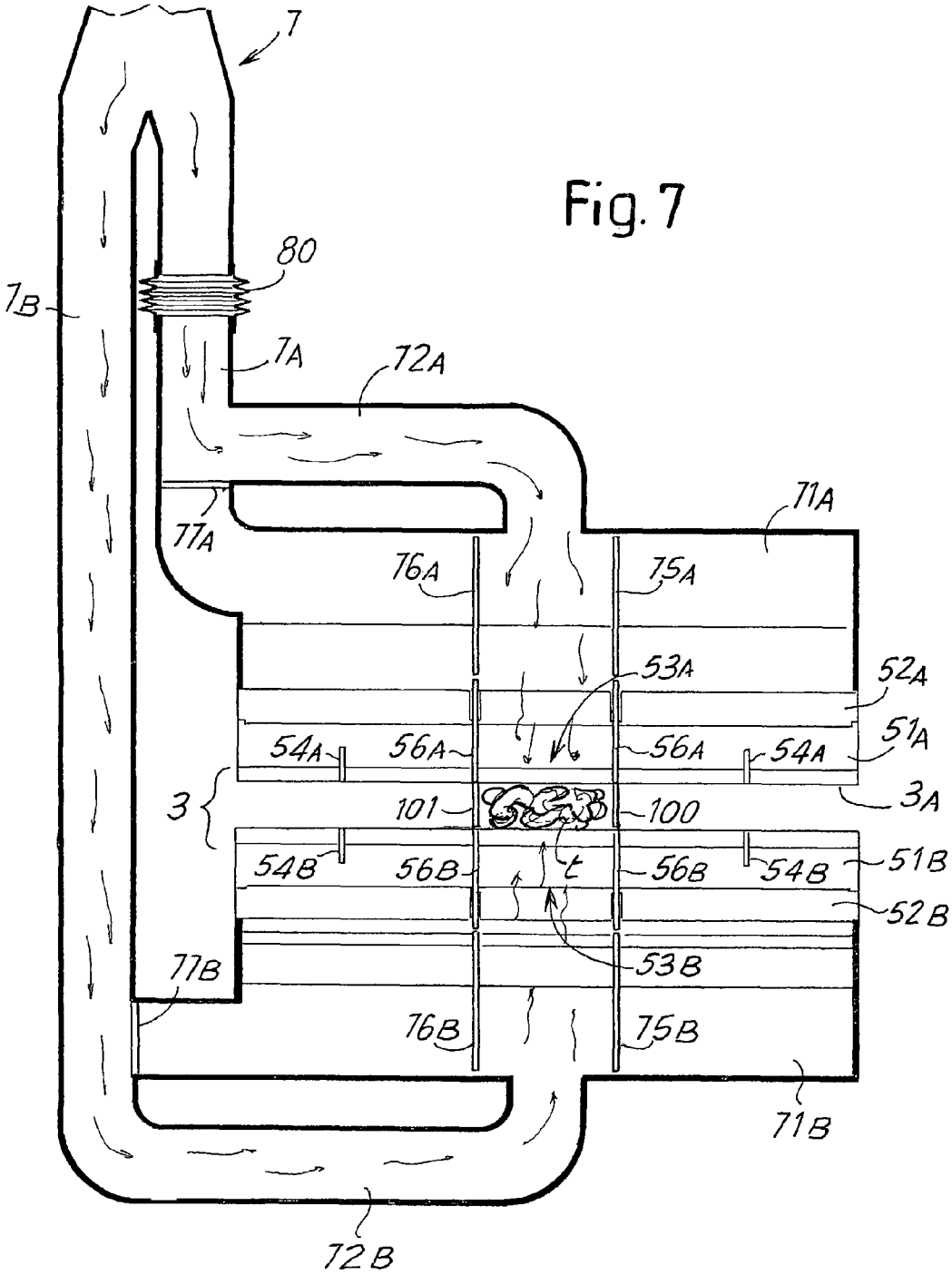
FIG. 7 shows a section according to VII-VII in FIG. 6.

FIGS. 5 to 7 show the same machine described hereinbefore in the configuration to treat fabric in rope form indicated with t.

FIG. 5 shows the machine in an axonometric view equivalent to the one in FIG. 2, but configured to process the fabric in rope form. In this configuration the pressurized air is introduced through the central duct 72A into the storage tank 71A by means of the gate 77A, which now closes the final part of the duct 7A. The air is then conveyed from the two gates 75A and 76A, closed to form a central channel through the storage tank 71A, to the central blower 53A to transfer the fabric in rope form t below.

In particular, the central dividing elements 56A, i.e. those below the gates 75A and 76A, advantageously have a shape extended further in an upwards direction with respect to the other dividing elements, to offer improved channeling of the air during processing of the fabric in rope form t.

In an advantageous embodiment of the invention, the upper part 3A of the duct 3 is raised and the two central gates 100 and 101, hinged in the upper part 3A of the duct 3, rotate to form a path with an approximately square smaller section suitable for transfer of the fabric in rope form t.

Raising of the upper part 3A of the duct 3 can be implemented by means of a telescoping or bellows joint 80 which raises the part of the pneumatic transfer system 5 positioned above the fabric and a part of the pneumatic system 7, i.e. the elements previously indicated with the letter A.

Advantageously, the part of the pneumatic transfer system 5 positioned below the fabric and the relative pneumatic system 7, the elements of which are indicated with the letter B, remain fixed.

The grilles 15D and 15S can advantageously be raised, remaining for example fastened to the surface 3A of the duct 3, or can be fixed, fastened for example on the respective mouths 16 and 17.

The direction of transfer of the fabric in rope form towards the tank 11 or towards the tank 13 is obtained by moving the gates 52A and 52B, as in the previous configuration for open width fabric.

In an advantageous embodiment of this configuration in which fabric in rope form t is processed, the tanks 11 and 13 respectively have walls or side elements 111 and 133 which are moved towards each other to form a narrower path inside the tanks 11 and 13. In this way the fabric in rope form has less free space to extend or become knotted.

FIG. 6 shows a view according to VI-VI in FIG. 5 partially in section configured to process fabric in rope form.

Comparing FIG. 6 with FIG. 3, which shows the same section but with a configuration for processing open width fabric, it can be seen how the upper surface 3A of the duct 3 is raised vertically thanks to the telescoping or bellows joint 80, which allows raising of the upper components of the pneumatic transfer system 5 and part of the relative pneumatic system, i.e. the elements indicated with the letter A. This raising is of a limited extend, preferably approximately 10 cm, and, together with rotation of the central gates 100 and 101, produces a transfer channel 3 with an approximately square smaller section, inside which the fabric in rope form t is transferred.

The central gates 100, 101, which in this embodiment are composed of elements hinged about fixed axes, can also be composed in a different manner. For example, they can be movable vertically between a position inserted in the path of the fabric and a withdrawn position. Preferably, these gates can be provided with a translatory movement to move towards and away from each other. When the fabric is to be treated in open width they are moved reciprocally away from each other. When the fabric is to be treated in rope form they are moved towards each other. It is thereby possible to set the width of the transfer duct of the fabric at will. The movement can, for example, be obtained by connecting the central gates 100, 101 to two nut screws which engage on threaded portions with opposed threads of a common threaded bar, rotation of which consequently causes the gates to reciprocally move towards or away from each other.

FIG. 7 shows a lateral section according to VII-VII in FIG. 6 partially in section configured to process fabric in rope form.

Figure 4:
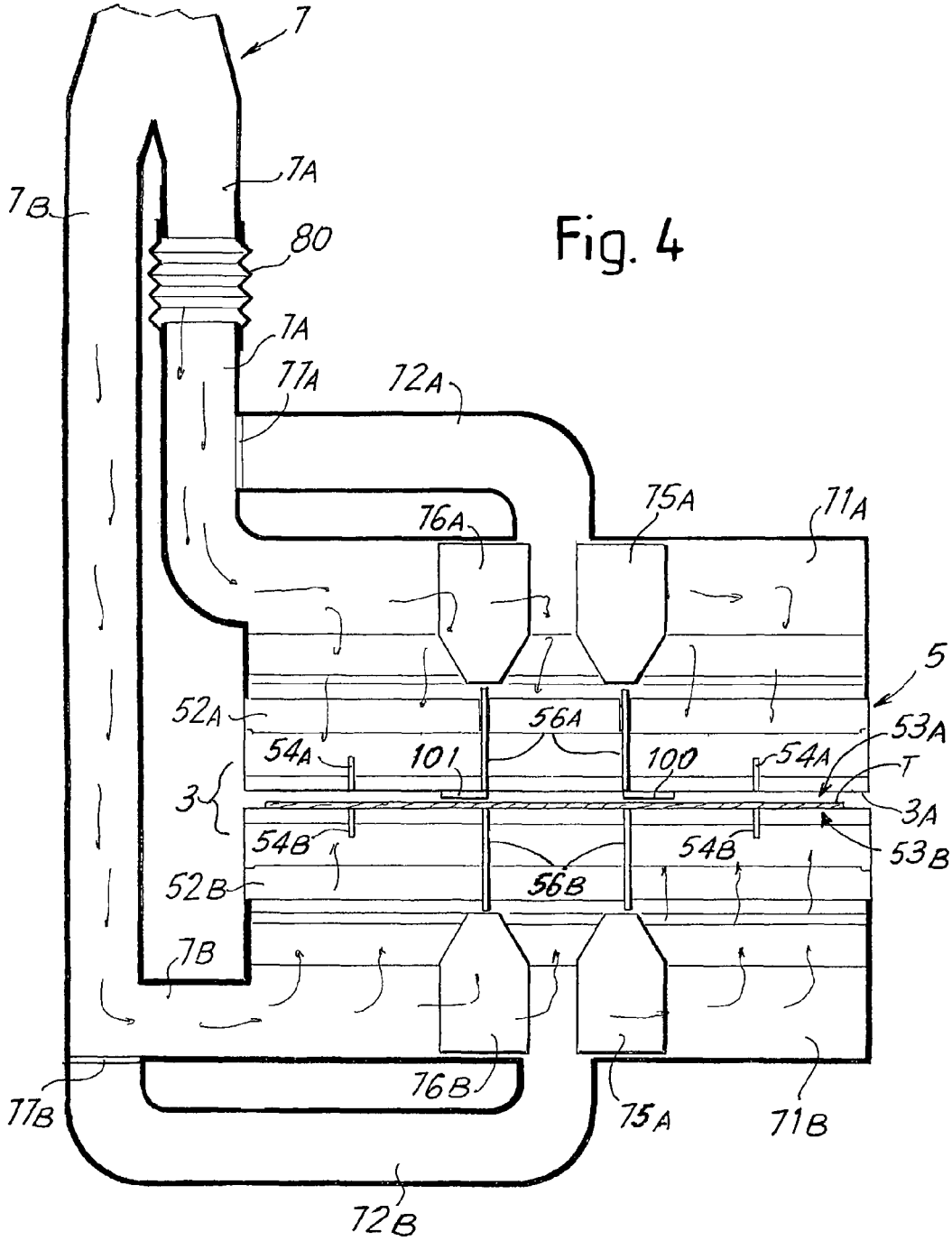
FIG. 4 shows a section according to IV-IV in FIG. 3.

Comparing FIG. 7 with FIG. 4, which shows the same section but with a configuration to process open width fabric, it can be seen how raising of the upper pneumatic transfer system 5, lowering of the central fins 100 and 101 and closing of the upper 75A and 76A and lower 75B and 76B gates form a narrow central path suitable for pressurized transfer of the fabric in rope form t.

It is understood that the drawing purely shows a possible non-limiting embodiment of the invention, which may vary in forms and arrangements without departing from the scope of the concept on which the invention is based. Any reference numerals in the appended claims are provided for the sole purpose of facilitating the reading thereof in the light of the description hereinbefore and the accompanying drawings and do not in any way limit the scope of protection.

The invention claimed is:

1. A machine for processing a fabric, comprising:

a transfer path for the fabric along which a pneumatic transfer system is disposed, said transfer system including a transfer duct inside which said fabric is transferred, wherein said transfer duct has a cross section with variable geometry to alternatively process open width fabric or fabric in rope form, said transfer duct having panels and/or walls movable to vary the geometry of said cross section.

2. Machine as claimed in claim 1, wherein said duct has at least one portion with a cross section with dimensions modifiable from a narrower and elongated conformation to treat open width fabric to a wider and shorter conformation to treat fabric in rope form.

3. Machine as claimed in claim 1, wherein said cross section can be adjusted with an automatic conversion operation, without acting manually on the mechanics of the machine.

4. Machine as claimed in claim 1, wherein said cross section can be adjusted with an automatic conversion operation, without acting manually on the mechanics of the machine.

5. Machine as claimed in claim 1, wherein said path is disposed between an inlet and an outlet of said machine, said machine operating in continuous mode.

6. Machine as claimed in claim 1, wherein said path is disposed between an inlet and an outlet of said machine, said machine operating in continuous mode.

7. Machine as claimed in claim 1, wherein said path has at least one portion extending substantially horizontally.

8. Machine as claimed in claim 1, wherein said transfer system comprises transfer devices which can be activated alternatively along the entire transverse direction of the open width fabric, or only in part for transfer of the fabric in rope form, according to whether the machine is configured to process open width fabric or fabric in rope form.

9. Machine as claimed in claim 1, wherein said transfer system includes transfer devices positioned at least on one side of said path.

10. Machine as claimed in claim 1, wherein said transfer system is bidirectional, to transfer said fabric alternatively in one direction and in the opposite direction.

11. Machine as claimed in claim 10, wherein said transfer system comprises at least a pair of substantially symmetrical and opposite transfer devices, to transfer said fabric alternatively in one direction or in the opposite direction.

12. Machine as claimed in claim 1, wherein said transfer system comprises transfer devices acting on both sides of the path, to act on both faces of said fabric.

13. Machine as claimed in claim 1, wherein said pneumatic transfer system includes at least one Venturi tube or the like in which said fabric is transferred.

14. Machine as claimed in claim 1, wherein said transfer system includes air blowers positioned side by side.

15. Machine as claimed in claim 1, wherein a pneumatic circuit is associated with said pneumatic transfer system, comprising a pressurized air source, which feeds air into at least one storage tank.

16. Machine as claimed in claim 15, wherein said transfer system includes air blowers positioned side by side and wherein said at least one storage tank is in fluid connection with said blowers.

17. Machine as claimed in claim 15, wherein said at least one storage tank extends transverse to the direction of transfer of the fabric in said path and comprises means to modify the internal volume of the storage tank as a function of the type of treatment, open width or rope form, performed on the fabric.

18. Machine as claimed in claim 17, wherein at least two ducts are associated with said at least one storage tank, to feed air delivered from said pressurized air source, said ducts being used alternatively for open width or rope form operation, cut-off means being provided to close one or the other of said two ducts.

19. Machine as claimed in claim 18, wherein one of said ducts flows into the respective storage tank in a central position and is activated for rope form operation.

20. Machine as claimed in claim 19, wherein two intermediate gates are provided in said at least one storage tank, which close to form a central channel to convey air in the direction of at least one central blower, said gates closed when the machine operates in rope form.

21. Machine as claimed in claim 16, wherein means are associated to one of said blowers in position to transversely delimit the flow of air when the machine operates in rope form.

22. Machine as claimed in claim 1, wherein said transfer system comprises at least a part raisable to allow transfer of said open width fabric or alternatively said fabric in rope form.

23. Machine as claimed in claim 22, wherein said raisable part comprises a diverter for the air and terminates with air blowers.

24. Machine as claimed in claim 23, wherein a fin is associated with said diverter to alternatively activate a first series of blowers and a second series of blowers.

25. Machine as claimed in claim 23, wherein said fin extends transversely along the direction of transfer of the open width fabric.

26. Machine as claimed in claim 1, wherein mechanical treatment systems are provided along said path, produced with impact elements permeable to air positioned in front of the transfer system, against which the fabric is impacted by means of kinetic energy imparted thereto by the transfer system.

27. Machine as claimed in claim 26, wherein a suction and recirculation circuit is associated with said impact elements.

28. Machine as claimed in claim 27, wherein said impact elements are produced with at least one grille structure.

29. Machine as claimed in claim 28, wherein said transfer system is bidirectional, to transfer said fabric alternatively in one direction and in the opposite direction, and said mechanical treatment systems are produced with two grilled structures positioned in front of said bidirectional transfer system, on opposite sides thereof.

30. Machine as claimed in claim 27, wherein at least one respective suction mouth of said suction and recirculation system is positioned on the opposite side of each impact element with respect to the transfer system.

31. Machine as claimed in claim 1, including at least a first tank and a second tank positioned in series and connected by means of said path.

32. Machine as claimed in claim 31, wherein said tanks have means to modify the width as a function of the type of treatment performed by the machine.

33. Machine as claimed in claim 1, including a fabric feeder and a fabric removal device.

34. Machine as claimed in claim 33, including means to feed open width fabric and remove open width fabric, even if the treatment is performed on fabric in rope form.

35. Machine as claimed in claim 1, wherein one or more of the following elements are provided in line on the inlet side: an unwinder of roll of fabric, a padding mangle, pre-drying cylinders; and wherein one or more of the following elements are provided in line on the outlet side: a winder, a continuous rope opener, a folder.

36. A machine for processing a fabric, comprising:

a transfer path for the fabric along which a pneumatic transfer system is disposed, said transfer system including a transfer duct inside which said fabric is transferred, said transfer duct having a cross section with variable geometry to alternatively process open width fabric or fabric in rope form, wherein said cross section can be adjusted with an automatic conversion operation, without acting manually on the mechanics of the machine.

37. A machine for processing a fabric, comprising:

a pneumatic transfer system, said transfer system comprising one or more walls defining a transfer duct, said one or more walls being mounted for movement such that said one or more walls move from a first position to a second position, said one or more walls defining at least a portion of a transfer path of the fabric, said transfer duct receiving open width fabric with said one or more walls in said first position, wherein at least a portion of said transfer duct has a first transfer duct cross sectional dimension with said one or more walls in said first position, said transfer duct receiving fabric in rope form with said one or more walls in said second position, wherein at least a portion of said transfer duct has a second cross sectional dimension with said one or more walls in said second position, said first cross sectional dimension being different from said second cross sectional dimension.

38. Machine as claimed in claim 37, wherein said at least said portion of said transfer path is disposed between an inlet and an outlet of said pneumatic transfer system, said pneumatic transfer system operating in continuous mode.

39. Machine as claimed in claim 37, wherein said one or more walls vary a geometry of said cross section of said transfer duct.

40. Machine as claimed in claim 37, wherein said cross section of said transfer duct can be adjusted with an automatic conversion operation, without acting manually on the mechanics of the machine.

* * * * *